US005392550A

United States Patent [19]

Moore et al.

[11] Patent Number: 5,392,550

[45] Date of Patent: Feb. 28, 1995

[54] INTERNAL LASER SIGHT FOR WEAPONS

[76] Inventors: Larry Moore, 1598 Sierra Dr., P.O. Box 1861, Cottonwood, Ariz. 86326; Keith D. Halsey, 2824 Second St., Santa Monica, Calif. 90405

[21] Appl. No.: 4,451

[22] Filed: Jan. 14, 1993

[51] Int. Cl.[6] ..... F41G 1/36

[52] U.S. Cl. ..... 42/103; 362/110; 362/196; 362/204

[58] Field of Search ..... 42/103; 362/110, 196, 362/203, 204

[56] References Cited

U.S. PATENT DOCUMENTS

| | | | |
|---|---|---|---|
| 1,088,502 | 2/1914 | Williams | 362/114 |
| 1,215,171 | 2/1917 | Lewis et al. | 362/110 |
| 2,017,585 | 10/1935 | Casey | 362/114 |
| 2,085,732 | 7/1937 | Baxter et al. | 42/103 |
| 2,272,907 | 2/1942 | Deibel | 362/204 |
| 4,542,447 | 9/1985 | Quakenbush | 362/183 |
| 4,581,686 | 4/1986 | Nelson | 362/204 |
| 4,627,183 | 12/1986 | Stuckman | 362/110 |
| 4,697,226 | 9/1987 | Verdin | 362/110 |
| 4,707,772 | 11/1987 | Jimenez et al. | 362/110 |
| 4,777,754 | 10/1988 | Reynolds | 42/103 |
| 4,856,218 | 8/1989 | Reynolds | 42/103 |
| 4,876,816 | 10/1989 | Triplett | 42/103 |
| 4,916,579 | 4/1990 | Simms | 362/18 |
| 4,934,086 | 6/1990 | Houde-Walter | 42/103 |
| 5,008,785 | 4/1991 | Maglica et al. | 362/190 |
| 5,092,071 | 3/1990 | Moore | 42/85 |

FOREIGN PATENT DOCUMENTS

| | | | |
|---|---|---|---|
| 645021 | 7/1962 | Canada | 362/203 |
| 69174 | 4/1941 | Czech Rep. | 362/203 |
| 1442357 | 5/1966 | France | 362/203 |
| 654655 | 2/1986 | Switzerland | 362/110 |
| 102785 | of 1916 | United Kingdom . | |
| 2209387 | 5/1989 | United Kingdom | 362/204 |

*Primary Examiner*—Stephen M. Johnson

[57] ABSTRACT

An internally mounted laser beam gun sight suitable for use in automatic pistols is provided by replacing the conventional recoil spring guide rod with a hollow tube having substantially the same exterior shape and dimensions, but containing a laser beam generation module, batteries and an on/off switch within its hollow bore. In a preferred embodiment, the hollow tube has two portions which are movable with respect to each other. A first portion contains the batteries and a second portion contains the laser module. An insulated bushing containing a central electrical contact is located between the two portions. In the preferred embodiment, the central contact forms part of an internal electrical switch which is activated by relative motion of the first and second portions of the guide tube to turn the laser beam on and off.

4 Claims, 5 Drawing Sheets

INTERNAL LASER SIGHT FOR WEAPONS

FIELD OF THE INVENTION

The present invention concerns an internally mountable light beam sight for weapons and weapons containing such.

BACKGROUND OF THE INVENTION

It is well known in the art to utilize a light beam as a sighting aid for weapons. An illumination source is provided that projects a narrow beam of light in a direction parallel to the weapon boresight. When light beam and boresight are properly aligned, the bullet impact will be on or very close to the location of the light spot on the target. Light beam sighting aids are particularly useful at night when ordinary iron or telescopic sights are difficult to use because of low ambient and/or target illumination levels.

Lasers are the preferred means of generating light beams for sighting applications. They have comparatively high intensity, small spot size, and can be focused into a narrow beam with a very small divergence angle. Laser sights for weapons are well known in the art.

Heretofore, laser sights have been comparatively bulky and mounted outside of the weapon. With long guns, the bulk required for the laser sight is small compared to the size of the gun, that is, the additional volume and weight are a small percentage of the volume and weight of the gun itself. However, with hand guns, the typical externally mounted laser sight is a significant fraction of the volume of the gun itself and a gun with such a sight cannot generally be carried in a conventional holster. This is a great disadvantage, both because of the additional space required for the laser sight, and also because the externally mounted laser sight is comparatively easily damaged or knocked out of alignment. In police and military applications, there is a great premium on compact and extremely rugged weapons. Thus, there is a great desire to have a laser sight which is internal to the weapon so as to be protected from rough handling and which does not add to the bulk of the weapon.

In U.S. Pat. No. 4,934,086, Houde-Walter describes an arrangement in which an internal laser light source is provided within an automatic pistol. A laser diode or fiber-optic light conductor coupled to a laser diode is mounted so as to project the laser light beam along the bore of a hollow recoil spring guide tube. The recoil spring guide tube is located within the weapon beneath and parallel to the barrel. A light beam emanating from the recoil spring guide tube projects forward in the same general direction as the bullet travels. The battery and other electronics necessary to power the laser diode in Houde-Walter's arrangement, are mounted in the butt of the weapon.

A disadvantage of this arrangement is that substantial modification of the weapon may be needed to accommodate the battery, drive circuitry, and fiber-optic or electrical connections leading up to the recoil spring guide tube. As a practical matter, modification of a weapon to accommodate such spaced-apart or remotely located components may require a skilled gun smith. This limits the applicability of such an internal laser sight arrangement to those who can afford such modifications to their weapons, and to weapons which have sufficient un-used space within the butt or frame to accommodate the spaced-apart components.

Thus, there continues to be a need for a compact, internally mounted laser sight for hand guns, especially for a laser sight that is adapted to fit a wide variety of weapons and which may be installed by ordinary users without need for an expert gun smith and without significant structural modification of the weapon.

SUMMARY OF THE INVENTION

Advantages of the present invention are that it provides an internally mountable laser sight assembly that may be installed by persons of ordinary skill, and that it easily adapts to a wide variety of weapons without custom structural modifications of the weapon. The laser beam may be readily aligned to correspond to the weapon boresight prior to installation of the laser sight assembly in the weapon.

The foregoing and other advantages are provided by a light beam sightable weapon, comprising, a hollow tube mounted within the weapon, In a preferred embodiment, the hollow tube has a first portion and a second portion. The first portion is coupled to the weapon and the second portion moves with respect to the first portion. A light beam generation means is mounted within the tube for projecting a light beam out of the tube. An energy storage means is provided and coupled to the laser beam generation means for energizing the laser beam generation means. A switch means is electrically interposed between the energy storage means and the light beam generation means for turning the light beam on and off when actuated by movement of the second portion of the tube relative to the first portion of the tube.

In a preferred embodiment, the light beam is projected out an end of the tube and the tube serves as a recoil spring guide tube. It is desirable that the first and second portions of the tube are coaxially aligned and the second portion rotates with respect to the first portion around their common axis so as to make or break internal axially mounted electrical contacts in a circuit coupling the energy storage means and the light beam generation means.

It is further desirable that the light beam generation means is internal to the second portion and coupled thereto by a flexible mounting proximate a first end and a transversely adjustable mounting proximate a second end of the light beam generation means. The flexible mounting means desirably comprises an O-ring captured between the light beam generation means and an interior wall of the tube.

The foregoing and other advantages of the present invention will be more fully understood by reference to the figures and accompanying text.

DETAILED DESCRIPTION OF THE PREFERRED EMBODIMENT

Figures 1, 2, 3, 4:
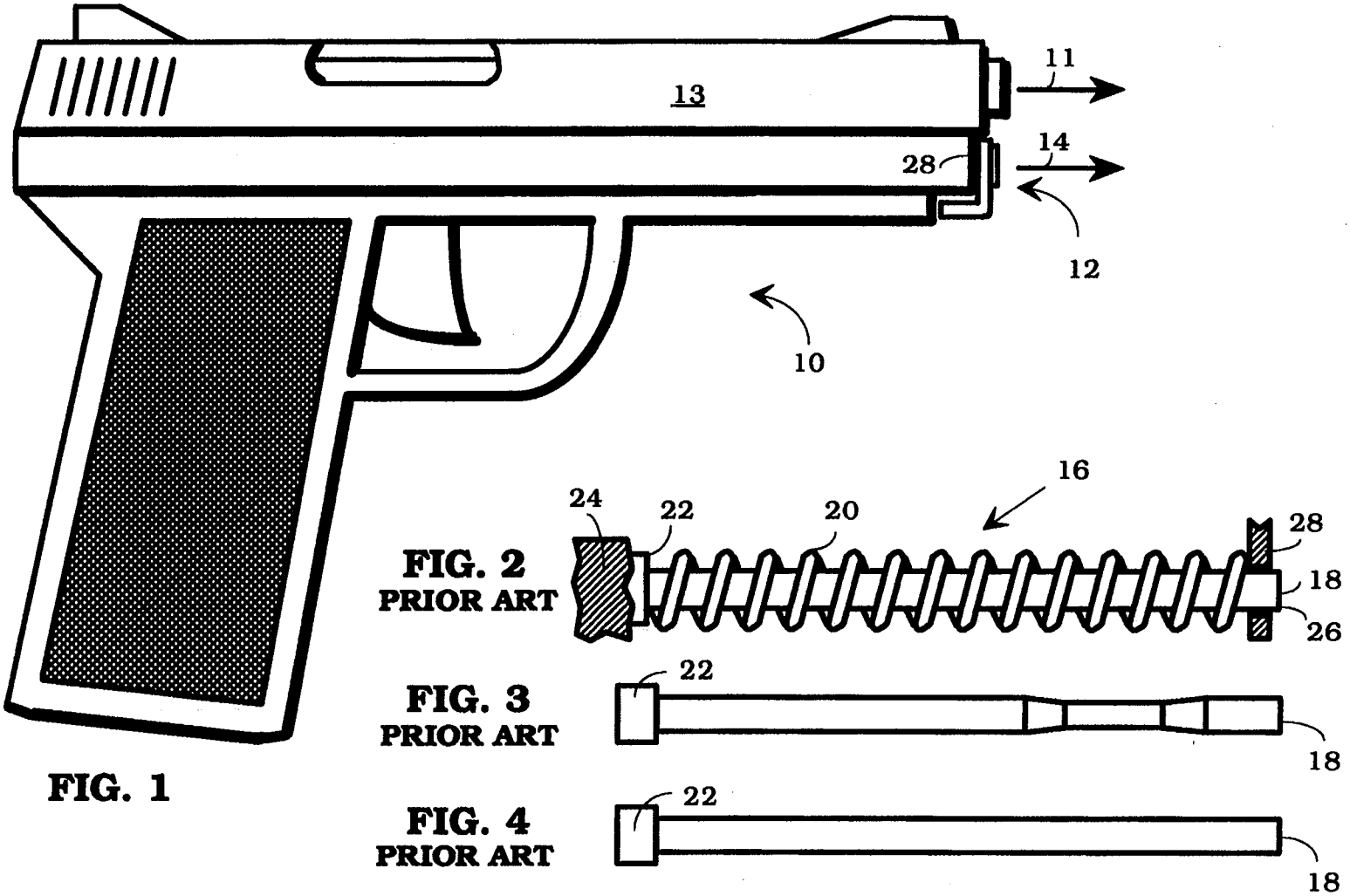
FIG. 2 PRIOR ART
FIG. 3 PRIOR ART
FIG. 4 PRIOR ART
FIG. 1 is a simplified side view of an automatic pistol containing a laser sighting assembly according to the present invention.
FIG. 2 is a simplified partial cut-away side view of a conventional recoil spring and guide rod assembly according to the prior art.
FIGS. 3–4 are simplified side views of recoil spring guide rods according to the prior art, similar to that shown in FIG. 2, but without the recoil spring.

FIG. 1 is a simplified side view of an automatic pistol 10 adapted to fire projectiles in bore-sight direction 11, and in which has been mounted laser sighting assembly 12 producing emergent light beam 14, according to a first embodiment of the present invention. Except for laser sighting assembly 12, the other portions of weapon 10 are substantially conventional. The pistol depicted in FIG. 1 is in a non-firing state. Portion 13 of weapon 10 contains the breech and is referred to as the "slide". Slide 13 moves back and forth parallel to direction 11 when the weapon is fired.

FIG. 2 is a simplified partial cut-away side view of conventional recoil spring and guide rod assembly 16 according to the prior art. Assembly 16 would be contained within a pistol of the type shown in FIG. 1 if manufactured in the conventional manner without the laser sighting assembly of the present invention. Assembly 16 comprises guide rod or tube 18 and spring 20. FIGS. 3–4 show prior art guide rods or tubes of various types with spring 20 removed, as would be seen when guide rod or tube 18 is removed from the weapon.

Guide rod or tube 18 has first end 22 which is generally fixed in relationship to portion 24 of the frame of gun 10, and second end 26 which has thereon movable portion 28 of gun 10. Movable portion 28 is generally coupled to the weapon breech so that when the weapon fires, portion 28 slides to the left along guide rod 18.

Figures 5, 6, 7, 8, 9:
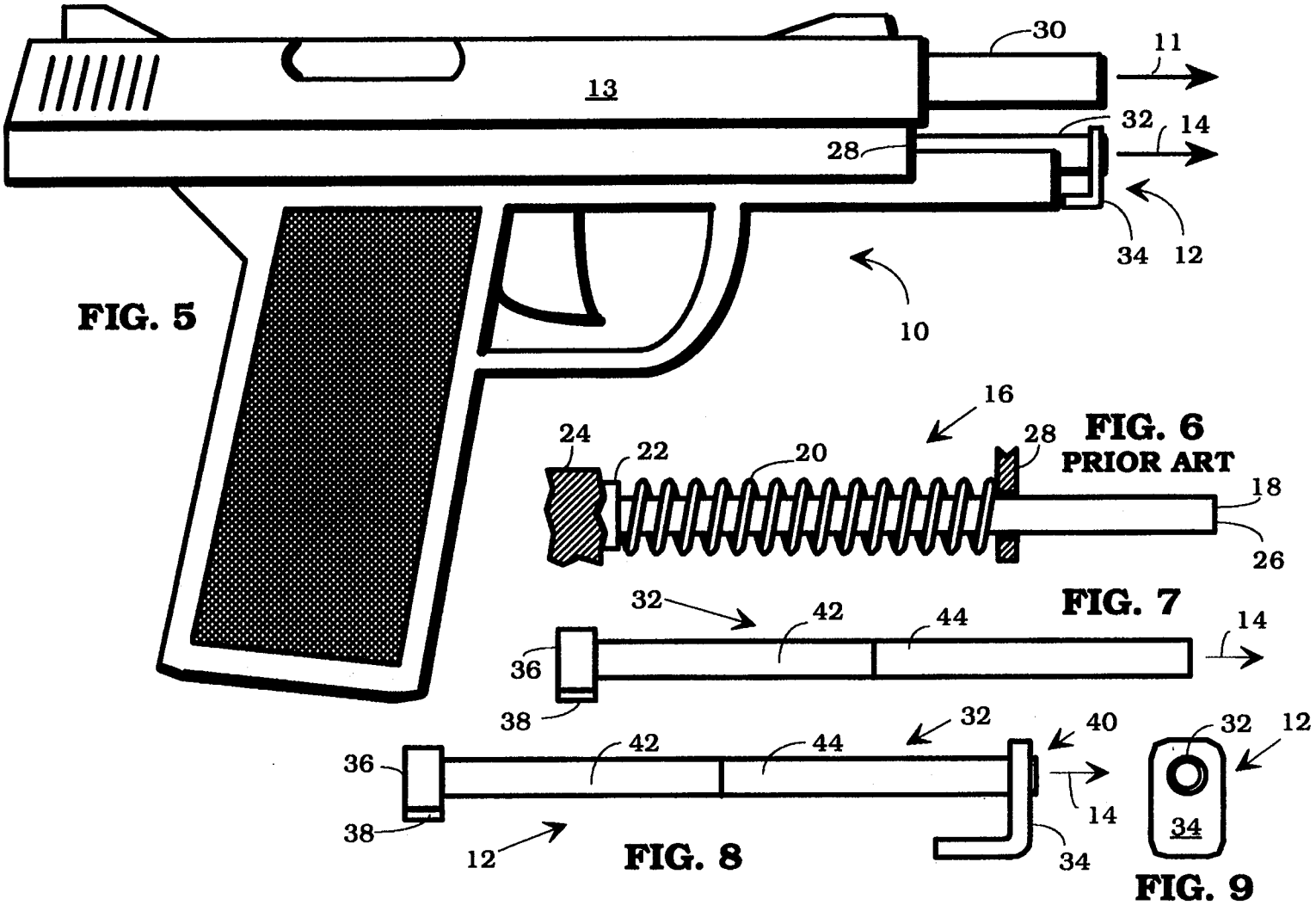
FIG. 6 PRIOR ART
FIG. 5 is a view similar to FIG. 1, but showing the location of the weapon slide when the weapon is firing and the breach has recoiled.
FIG. 6 is a view of the same prior art assembly as in FIG. 2 showing the compression of the recoil spring when the weapon in which it is contained is in the state depicted in FIG. 5.
FIG. 7 is a simplified side view of a recoil spring guide tube having therein a laser beam generation means, according to a first embodiment of the present invention.
FIG. 8 is a view of the tube of FIG. 7 according to the present invention, but with a rotational lever attached to the forward end.
FIG. 9 is a right side (end) view of the tube and lever of FIG. 8.

FIG. 5 is a view similar to FIG. 1, but showing the location of weapon slide 13 with moving portion 28 when weapon 10 is firing and slide 13 has recoiled to expose barrel 30 and guide rod 32. FIG. 6 is a view of the same prior art assembly 16 as in FIG. 2 showing the compression of recoil spring 20 when the weapon in which it is contained is in the state depicted in FIG. 5;

FIG. 7 is a simplified side view of laser beam generation and guide red assembly 12 according to the present invention. Assembly 12 comprises guide tube 32 of substantially the same exterior dimensions as guide rod or tube 18. The laser beam generation means of the present invention is preferably entirely housed within tube 32. FIG. 8 is a view of the tube of FIG. 7 according to the present invention, but with rotational lever 34 attached to the forward end, and FIG. 9 is a right side (end) view of the tube and lever of FIG. 8.

In a preferred embodiment, tube 32 has end portion 36 similar in exterior dimensions and shape to end portion 22 of guide rod 18. Key 38 is optionally provided to prevent end 36 from rotating when tube 32 is assembled to gun frame portion 24, in place of guide rod 18. Tube 32 has end 40 to which lever 34 is conveniently attached.

Tube 32 has at least two portions 42, 44 which may be moved relative to each other. Portion 42 is coupled to substantially fixed end 36 (held by gun frame portion 24) and portion 44 to lever 34. When tube 32 is assembled in gun 10, recoil spring 20 surrounds tube 32 and slide portion 28 moves along tube 32 compressing spring 20, in the same manner as for assembly 16 in FIG. 6. The mechanical action of recoil spring 20 and the spring guiding function of tube 32 are conventional and when placed in gun 10, assembly 12 performs the same mechanical function as does spring and guide rod assembly 16. However, assembly 12 of the present invention performs the additional function of providing light beam 14 aligned to weapon boresight 11. As will be presently explained, lever 34 allows portion 44 of tube 32 to be moved relative to portion 42, so as to turn light beam 14 on and off.

Figure 10:
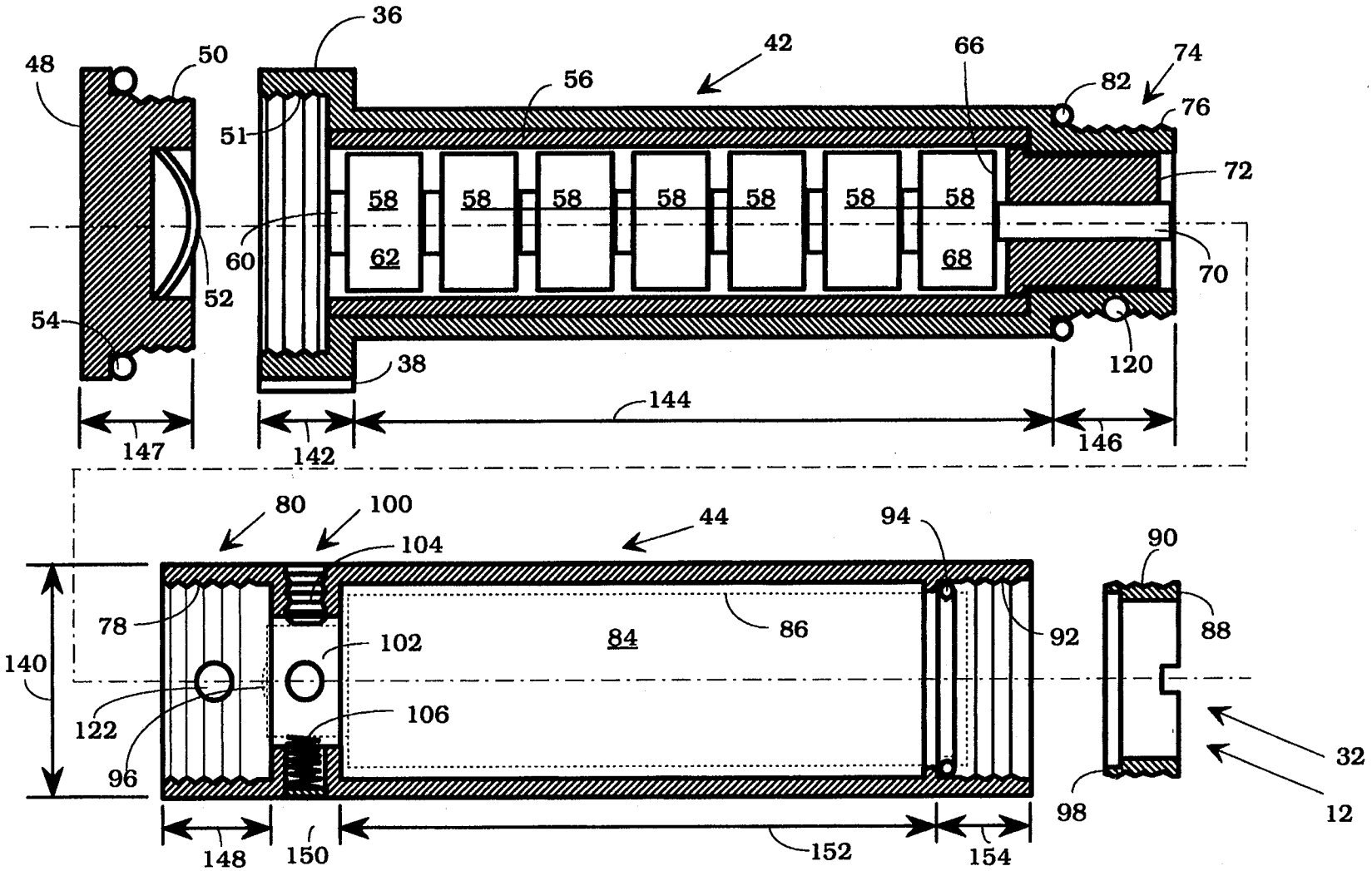
FIG. 10 is an exploded cross-sectional side and partial cut-away view of the tube of FIG. 7, showing interior details.

FIG. 10 is an exploded cross-sectional side and partial cut-away view of laser sight beam generation assembly 12 and tube 32 of FIGS. 7–9, according to the present invention and showing interior details. Lever 34 has been omitted for clarity. End region 36 of tube portion 42 comprises removable end cap 48. End cap 48 desirably engages end region 36 by means of threads 50, 51. End cap 48 comprises spring 52. O-ring 54 is conveniently provided so that cap 48 and end region 36 are desirably environmentally sealed. O-ring 54 also conveniently acts as a resilient member which is slightly compressed when cap 48 and end region 36 are engaged so as to improve the resistance of assembly 12 to the shock associated with firing weapon 10. End cap 48, end region 36 and tube portion 42 are desirably of metal, but any electrically conductive combination may be used.

Portion 42 of tube 32 is hollow and contains insulating sleeve or lining 56. Contained within insulating sleeve or lining 56 are one or more batteries 58. While seven batteries 58 are illustrated in FIG. 10, this is merely for convenience of explanation, and those of skill in the art will understand that one or more batteries may be used, the particular number being chosen by the user depending upon the electrical requirements of the particular light source being employed. Thus, for the purposes of the present invention, any number of batteries may be included within portion 42, depending on the electrical demands of the light source being employed and the available space within portion 42. In the example of FIG. 10, the individual batteries are of the single button-cell variety and are arranged electrically in series. Silver oxide type batteries manufactured by conventional methods are examples of suitable batteries. They are available with dimensions that will fit within recoil spring guide tubes suitable for use in one or more modem day automatic pistols.

When cap 48 is assembled to end region 36, spring 52 contacts pole 60 of out-board battery 62. Opposite pole 66 of inboard battery 68 contacts lead 70 held in place by insulating bushing 72 located within region 74 of tube portion 42. Lead 70 is typically of copper and insulating bushing 72 is conveniently of machinable or moldable plastic. Nylon TM, is an example of a suitable, well known and widely available plastic material. Region 74 of tube portion 42 desirably has threads 76 which mate with threads 78 in region 80 of tube portion 44. O-ring 82 is provided not only ,for environmental protection, but, more importantly, to increase the resistance of the assembly to the shock associated with firing the weapon by providing a resilient cushion that is slightly compressed when portions 42 and 44 are assembled.

Figure 11:
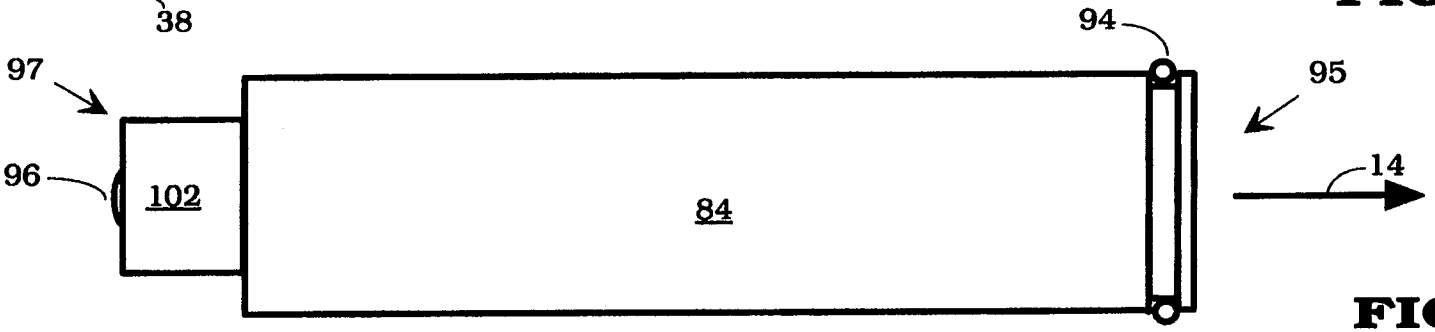
FIG. 11 is a simplified side view and FIG. 12 is a simplified cross-sectional and partial cut-away view, of a light beam generation module according to the present invention.
Figure 12:
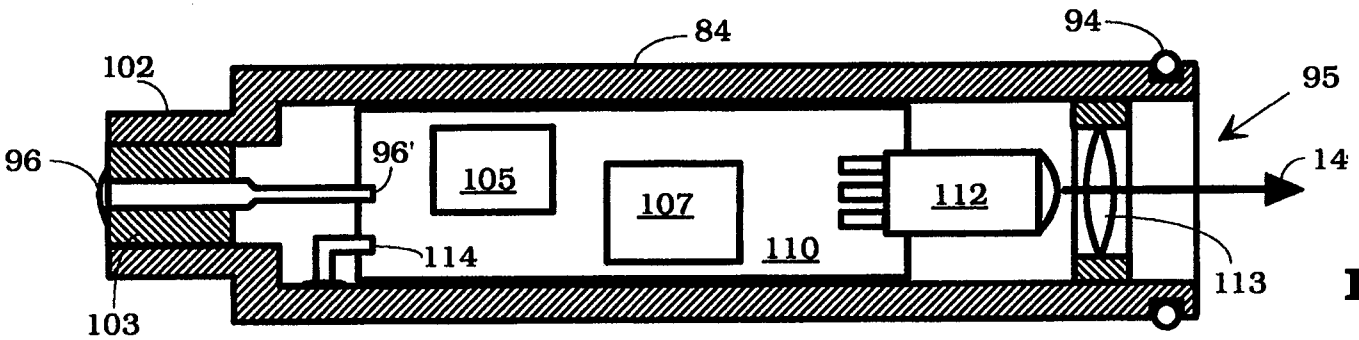

Portion 44 of tube 32 is hollow and houses light beam generating module 84 shown in further detail in FIGS. 11–12. Light beam generating module 84 is indicated in FIG. 10 by dashed outline 86 so that other details of the construction of portion 44 which would be obscured by module 84 may be seen. Module 84 is inserted into portion 44 from the right end in FIG. 10 and held in place by threaded retaining ring 88. Retaining ring 88 has threads 90 which mate with threads 92 of portion 44.

Referring now to FIG. 11, module 84 has near end 95, O-ring 94 and near end 97, electrical contact 96. When module 84 is inserted into portion 44 and retaining ring 88 mated with portion 44, annular portion 98 of ting 88 presses against O-ring 94 to clamp module 84 within portion 44. Retaining ring 88 desirably does not touch module 84. In this manner, module 84 is centrally located within portion 44 and held firmly but not rigidly. Accordingly, the longitudinal axis of module 84 may be tilted slightly one way or another with respect to the longitudinal axis of portion 44 of tube 32. It is highly desirable to be able to tilt the longitudinal axis of module 84 so as to be able to align light beam 14 with the central axis of tube 32 and/or boresight 11. In addition to allowing module 84 to be tilted, the O-ring support of end 95 aids in cushioning module 84 against the shock of gun 10 being fired.

Tube Portion 44 has adjacent to region 80, alignment adjustment means 100 which bears against portion 102 of module 84. Alignment adjustment means 100 conveniently comprises opposed set screws 104 and springs 106, as for example, a pair of each oriented at right angles. Set screws 104 and springs 106 bear against region 102 of module 84. By turning set screws 104 by varying amounts, the longitudinal axis of module 84 may be tilted relative to the longitudinal axis of tube 32 so that light beam 14 is coaxial with the longitudinal axis of tube 32 or any other vector, e.g., boresight direction 11 (see FIG. 1). The ability to adjust module 84 is important, since virtually all laser diodes (which are preferred as light sources) have a certain inherent amount of mis-alignment with respect to their housings so that, in order to have a highly accurate light sight, individual adjustment of the trajectory of the diode light beam is needed. Alignment means 100 makes this possible. In general, at a least three point support is needed for alignment means 100. Two pairs of opposed springs and set screws, provide four point support which is easily adjusted since, by arranging the screw-spring pairs to be orthogonal, the adjustments are independent. Once light beam 14 emitted from assembly 12 has been aligned to the desired direction, set screws 104 are conveniently locked in place (e.g., by a small drop of glue or paint) and no further adjustment is needed. Mechanism 84 conveniently has an electrically conductive outer casing.

FIGS. 11–12, show further details of module 84. FIG. 11 is a simplified side view and FIG. 12 is a simplified cross-sectional and partial cut-away view, of light beam generation module 84 according to the present invention. Module 84 comprises, conveniently, electrical circuit 110 for driving light source 112, e.g., a laser diode, and lens 113 for focusing light beam 14. Circuit 110 draws energy from batteries 58 by means of first lead 96-96' and second lead 114: First lead 96-96' conveniently has end 96 exposed on the axis of module 84 opposite emergent light beam 14. Lead 96-96' is supported by insulated bushing 103. Second lead 114 is conveniently coupled to conductive case of module 84. Electrical circuit 110 comprises suitable transistors or and/or integrated circuits (indicated generally by blocks 105, 107) which regulate the output from LED 112. Circuits for maintaining an approximately constant LED current and/or light output over a substantial range of battery voltage are well known in the art. For maximum battery life, it is desirable to utilize a regulating circuit which energizes the LED by means of pulses rather than continuously, but either arrangement is useful. The particular regulating circuit to be used depends upon the LED chosen by the designer, the number of batteries available and the voltage range over which the LED is required to function. Manufacturer's of LEDs and batteries provide information on the desirable operating ranges of their products which designers routinely use to select a regulator matched to their particular application. Those of skill in the art will understand how to provide a regulating circuit depending upon their choice of LED and batteries, without undue experimentation.

In the preferred embodiment, in order for diode 112 to be energized, lead 96 is advanced by varying the amount by which threads 76, 78 are engaged so as to have lead 96 in portion 44 and lead 70 in portion 42 make contact. Thus, leads 96, 70 in combination with threaded portions 74, 80 act as an electrical switch for turning laser assembly 12 on and off. Light beam 14 is turned on and off by moving portion 44 relative to portion 42. In the example shown, rotary motion of portion 44 relative to portion 42 causes leads 96, 70 to approach or retract from each other. While this arrangement is preferred, it is not essential, and as those of skill in the art will understand based on the description herein, that any means of moving portion 44 relative to portion 42 (or vice-versa) can be used to make and break a contact between leads 96, 70 and thus, control the electrical circuit.

Figure 13:
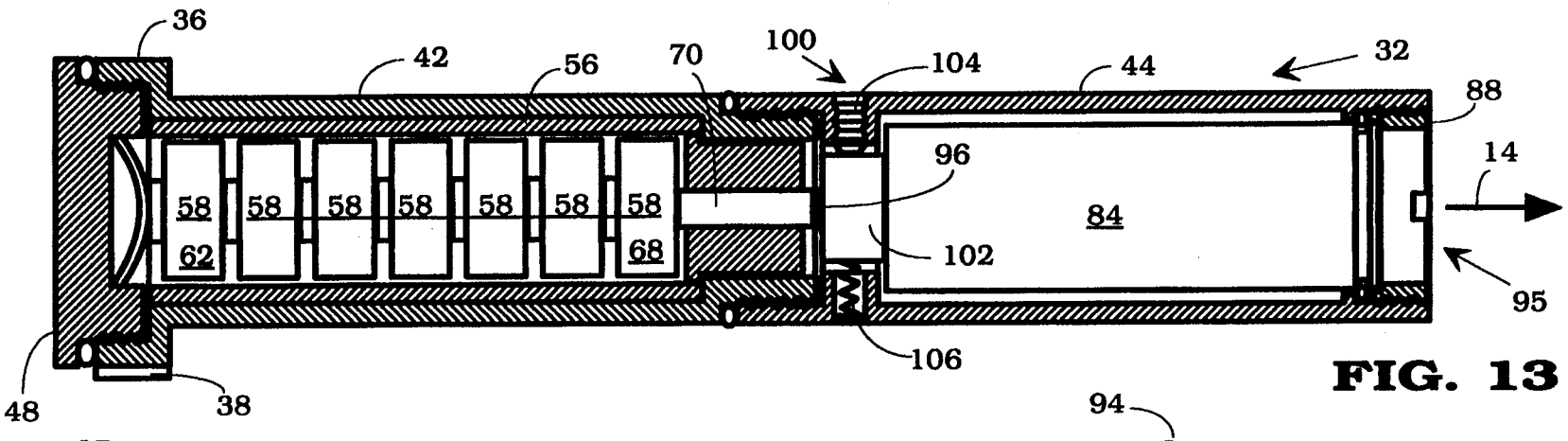
FIG. 13 is an assembled cross-sectional side and partial cut-away view of the tube of FIG. 10.

During assembly of tube 32, portions 44 and 42 are screwed together until only about one-quarter turn is needed to make or break the contact. Lever 34 is fixed to tube 32 (e.g., by a set screw) so that rotating lever 34 around the axis of tube 32 by approximately ninety degrees causes light beam 14 to be activated or deactivated. In order to have positive "on" and "off" positions, captured ball 120 is desirably provided in threaded region 74 and matching detents are provided about ninety degrees apart in threaded region 80 of portion 42, or vice-versa. Plastic (e.g., Nylon TM ) may be used for ball 120 so that some resilience is built-in. FIG. 13 is an assembled cross-sectional side and partial cut-away view of the tube of FIG. 10. Those of skill in the art will understand, based on the description herein, how to form tube 32 and bushing 72 without undue experimentation.

Figure 14:
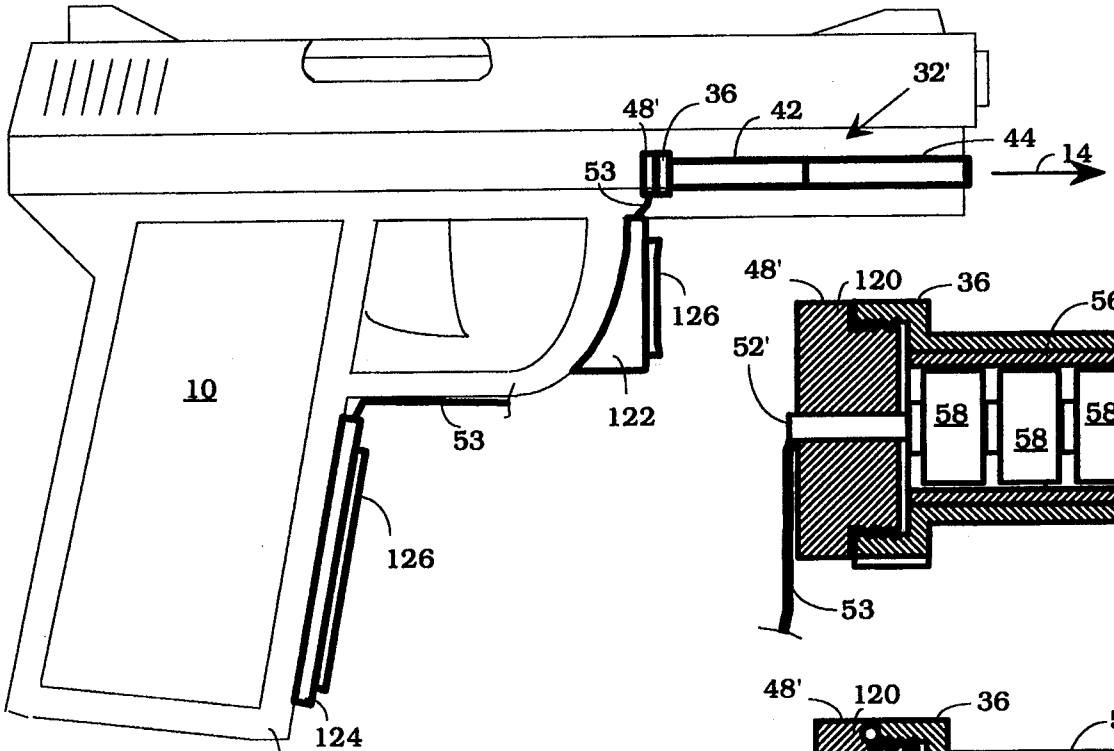
FIG. 14 is simplified phantom side view of pistol 10 similar to FIG. 1, but with a modified recoil spring guide tube according to a further embodiment of the present invention, installed therein.
Figure 15:
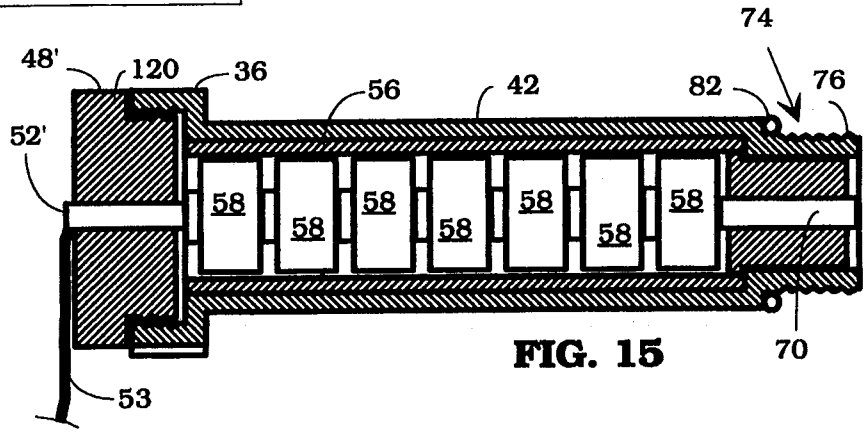
FIGS. 15–16 are partial cut-away and cross-sectional side views of a portion of the recoil spring guide tube of FIG. 14, showing further detail.
Figure 16:
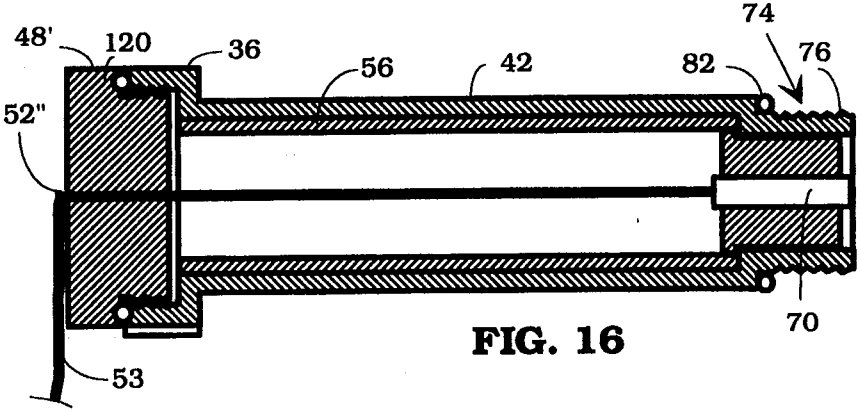
Figure 17:
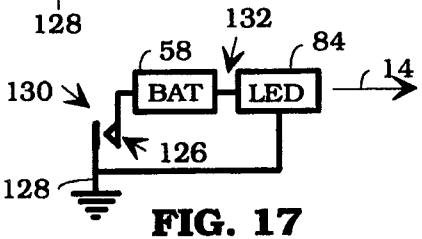
FIG. 17 is a simplified electrical schematic of the arrangement of FIGS. 14–16.

FIG. 14 is simplified phantom side view of pistol 10 similar to FIG. 1, but with modified recoil spring guide tube 32 according to a further embodiment of the present invention, installed therein. The recoil spring has been omitted for clarity. FIGS. 15–16 are partial cutaway and cross-sectional side views of portion 42 of the recoil spring guide tube of FIG. 14, showing further detail, and FIG. 17 is a simplified electrical schematic of the arrangement of FIGS. 14–16.

Portions 42 and 44 of tube 32' are as previously described and are installed such that leads 96 and 70 are in electrical contact. End portion 48' of tube 32' is modified to provide insulated bushing 120 through which extends conductor 52' (FIG. 15) or 52'' (FIG. 16). Conductors 52', 52'' are coupled to insulated lead 53 which extends from tube 32' to switch 122 or 124 mounted to frame 128 of gun 10. Switch 122 is conveniently mounted to the forward portion of the trigger guard and switch 124 is conveniently mounted to the forward edge of the butt. Either arrangement is useful and other locations on the gun, e.g., along the side of the weapon may also be used as a location for switch 122, 124. Switches 122, 124 are activated by depressing button or pad 126 which causes switch 130 to close (see FIG. 17), thereby coupling the electrical signal through the frame of the gun back to laser module 84. This is possible because, module 84 conveniently has a conductive housing to which one lead of circuit 110 is coupled (FIG. 12), and because most pistols utilize metal frames. In those instances where pistol 10 lacks a metal frame, an additional wire is used to provide continuity back to conductive spring guide tube 32.

FIG. 15 illustrates an embodiment in which batteries 58 are provided in tube portion 42 in substantially the same manner as already described, but where the on/off switching function for energizing LED 112 is accomplished by switch 122, 124. FIG. 16 illustrates a further embodiment in which batteries 58 are omitted from tube 32 and placed in switch 122 or 124. In this embodiment, switch 130 is at location 132 in the circuit of FIG. 17. Either arrangement is satisfactory. However, having batteries, LED and switch 69, 70 within tube 32, as for example as is shown in FIG. 13, avoids external switches 122, 124 and keeps the outer profile of the weapon especially clean and free from protrusions. This is desirable.

The following is an example of the construction of a fully self-contained internally mountable laser sighting assembly according to the present invention. Referring now to FIG. 10, a laser beam generation apparatus was constructed according to the present invention. Tube 32 has outer diameter 140 of about 0.34 inches, i.e., to fit a commonly available automatic pistol. Portion 36 has length 142 of about 0.165 inches, portion 42 has central length 144 of about 1.325 inches, and externally threaded length 146 of about 0.4 inches, including the space for O-ring 82. Tube portion 44 had internally threaded length 148 of about 0.425 inches, including small clearance regions at the beginning and end of the threads, adjustment region length 150 of about 0.125 inches, central chamber length 152 of about 1.475 inches and internally threaded length 154 of about 0.200. Retention ring 88 was sized to fit within threaded portion 92 of tube portion 44 and engage O-ring 94 to flexibly retain module 84, as previously described. Module 84 had an outer diameter less than 0.31 inches so as to fit within the bore of that size in the central part of tube portion 44. Lyte Optronics of Santa Monica, Calif. supplies laser modules of a size which will fit within a tube of 0.31 inch bore and such laser modules are suitable for use as laser module 84. Insulated spacer 72 was conveniently of Delrin TM. Tube 32 and portions 42, 44, 48 and 88 are conveniently fabricated from metal. Brass is suitable where fine threads and easy machinability are desired and iron alloys are more suitable for those portions which encounter heavy mechanical abrasion, as for example, from caused by recoil spring 20. Those of skill in the art will understand based on the description herein how to choose appropriate materials for constructing tube 32 and its various parts. Silver oxide batteries were used.

For proper operation, it is important to adjust the alignment of module 84 within tube portion 44 of tube 32 to provide light beam 14 in the correct direction. This is because laser diodes exhibit various optical anomalies which cause the beam emitted thereby to differ from the geometric axis of the LED package or housing. Thus, provision is made using alignment means 100 for aligning module 84 to provide beam 14 exiting in the desired direction, i.e., parallel to boresight 11. This is accomplished by placing tube portion 44 or assembled tube 32 in an alignment fixture have a known relationship to boresight 11 and adjusting screws 104 until beam 14 falls at the correct location relative to the fixture. Once this is accomplished, screws 104 may be locked in place with a drop of cement or paint or the like. The ability to mode module 84, i.e., tilt its longitudinal axis by small angles in any transverse direction, is provided by resilient mounting accomplished by O-ring 94, retention ring 88, and adjustment screws 104. These are important aspects of the present invention, since the permit the deficiencies of typical LEDs to be largely compensated before installation of tube 32 and assembly 12 in gun 10.

It is apparent based on the above description that the present invention provides a laser sight beam generation module and laser sighted gun in which, according to the preferred embodiment, the laser generation module, batteries and on/off switch are entirely housed within the spring guide tube of the weapon, so that an externally mounted sight is not required. This is a great advantage.

Further, the present invention permits the laser module to be properly aligned to compensate for astigmatism and other optical imperfections common in laser diodes so that the accuracy of the laser sight is not substantially degraded by such effects. In addition, the invented arrangement does not require modification of the gun and is easily adaptable to a large variety of weapons using recoil spring guide rods or tubes. These are desirable features.

Having thus described the invention, those of skill in the art will appreciate that numerous modifications can be made from the arrangements illustrated for purposes of explanation without departing from the spirit of the present invention. For example, while leads 69, 70 are conveniently brought into contact by use of screw threads, this is not essential and any means for making and breaking the contact may be used. Accordingly, it is intended to include these and such other variations as will occur to those of skill in the art based on the description herein, in the claims that follow.

What is claimed is:

1. A light beam generation assembly, comprising:

a hollow tube having first and second portions of substantially the same outer diameter which are movable relative to one another;

one or more batteries mounted in the first portion of the hollow tube;

a laser diode mounted in the second portion of the hollow tube;

switch means coupled to the first and second portions of the tube for making or breaking an electrical circuit coupling the batteries to the laser diode when the second portion is moved relative to the first portion; and wherein the laser diode is mounted within the tube by means of a mounting permitting angular adjustment of a direction of travel of a light beam emanating from the laser diode relative to a longitudinal axis of the tube.

2. The light generation assembly of claim 1 wherein the laser diode is mounted within a cylindrical housing which is suspended within the tube by said mounting, wherein said mounting supports the housing at two locations; (i) at a first location proximate a first end of the cylindrical housing and providing a resilient mounting allowing angular adjustment of the cylindrical housing relative to the longitudinal axis of the tube, and (ii) at a second location proximate a distal end of the cylindrical housing for providing said angular adjustment of the cylindrical housing.

3. The light beam generation assembly of claim 1 wherein a first end of the first portion of the tube is threaded and a first end of the second portion is threaded and the first and second portions are movably joined by means of said threads.

4. The light beam generation assembly of claim 3, wherein rotating the second portion relative to the first portion causes a contact within the second portion to advance along the axis of the tube and thereby touch another contact in the first portion, thereby completing the electrical circuit.

* * * * *